United States Patent [19]

Fletcher

[11] 4,058,306

[45] Nov. 15, 1977

[54] DETACK AND STRIPPING SYSTEM

[75] Inventor: Gerald M. Fletcher, Pittsford, N.Y.

[73] Assignee: Xerox Corporation, Stamford, Conn.

[21] Appl. No.: 689,277

[22] Filed: May 24, 1976

[51] Int. Cl.[2] ..... B65H 29/20

[52] U.S. Cl. ..... 271/80; 271/DIG. 2

[58] Field of Search ..... 271/80, DIG. 2; 11/60, 11/245; 432/60

[56] References Cited

U.S. PATENT DOCUMENTS

| | | | |
|---|---|---|---|
| 3,578,859 | 5/1971 | Stillings | 355/3 R |
| 3,804,401 | 4/1974 | Stange | 271/DIG. 2 X |
| 3,885,785 | 5/1975 | Burkett | 271/174 |

*Primary Examiner*—Richard A. Schacher

[57] ABSTRACT

In an electrostatographic copying system where a toner image on a photoreceptor is transferred to a copy sheet with transfer charges, which charges are removed from the copy sheet by passing the copy sheet under a detacking corona generator, the body of the copy sheet is supported to insure its stripping from the photoreceptor at a point under the detack corona generating electrode where the transfer charge thereon is only partially neutralized, while a restricted minor area of the lead edge of the copy sheet is stripped further downstream, where it has been substantially fully neutralized, at a fixed position controlled by a mechanical stripper finger.

10 Claims, 3 Drawing Figures

DETACK AND STRIPPING SYSTEM

The present invention relates to an improvement in electrostatographic copying apparatus for the removal of the final image support surface from the initial image support surface after the transfer of the image.

Common subject matter by the subject inventor is also disclosed in U.S. Pat. No. 4,017,065 issued Apr. 12, 1977, of the same assignee, filed April 1976, by Raymond E. Poehlein, entitled "Transfer-Fusing Speed Control".

In a transfer electrostatographic process such as conventional transfer xerography, in which an image pattern of dry particulate unfused toner material is transferred to a final image support surface (the copy sheet) from an initial image bearing surface (the charged photoreceptor surface developed with toner), the transferred toner is typically only loosely adhered to the final support surface after transfer, and is easily disturbed by the process of stripping the final support surface away from the initial support surface and by the process of transporting the final support surface to the toner fusing station. The stripping of the copy sheet is resisted by the electrostatic attraction between the transfer charge remaining on the copy sheet and the photoreceptor.

The final support surface preferably passes through a fusing station as soon as possible after transfer so as to permanently fuse the toner image to the final support surface, thereby preventing smearing or disturbance of the toner image by mechanical agitation or electrical fields. For this reason, and also for reasons of simplifying and shortening the paper path of the copier and space savings, it is desirable to maintain the fusing station as close as possible to the transfer station. A particularly desirable fusing station is a roll type fuser, wherein the copy sheet is passed through a pressure nip between two rollers, preferably at least one of which is heated and at least one of which is resilient. An example of a xerographic transfer, stripping, transporting and fusing system of this type is described in U.S. Pat. No. 3,578,859, issued May 18, 1971, to W. K. Stillings. These and the other references cited herein are hereby incorporated by reference.

The image transfer work station of an electrostatographic copying system has a difficult sheet handling problem because of the electrical effects on the sheet, and the severe limitations on the type of sheet handling mechanism which can be utilized without damaging the imaging surface or affecting the transfer process by disturbing the image before or after transfer. In the transfer station the copy sheet must be maintained in accurate registration with the toner image to be transferred. The transfer electrostatic fields and transfer contact pressure and spacing all affect good transferred image quality. Further, the sheet usually acquires an electrostatic tacking charge in the transfer process and the imaging surface has a charge on it as well. An uneven or non-uniform charge on the copy sheet or its transport as the sheet passes through the transfer station can cause transfer defects observable on the final copy.

In xerography, the toner image transfer is most commonly achieved by electrostatic force fields created by D.C. charges applied to or adjacent the back of the copy sheet while the front side of the copy sheet contacts the toner bearing bearing photoreceptor surface. The transfer fields must be sufficient to overcome the forces holding the toner onto the photoreceptor and to attract a substantial portion of the toner over onto the copy sheet. These transfer fields are generally provided on one of two ways: by ion emission of D.C. charges from a transfer corotron deposited onto the back of the copy paper, as in U.S. Pat. No. 2,807,233; or by a D.C. biased transfer roller or belt rolling along the back of the paper, and holding it against the photoreceptor. In either case the copy sheet must be held in registration with, and moved together with, the imaging surface in order to transfer a registered and unsmeared image. In the case of transfer accomplished by D.C. charges applied to the back of the copy sheet, these charges provide a substantial "tacking" force which electrostatically holds the copy sheet against the imaging surface for the movement of the copy sheet.

A particularly difficult problem in modern xerographic transfer systems is the reliable and consistent stripping of the copy sheet off of the imaging surface after the transfer of the image has been accomplished. Due to practical space and time constraints, this must generally be done as closely as possible after the transfer step, yet without disturbing the transferred toner image on the copy sheet. This image is readily disturbed by either mechanical or electrostatic forces since it is generally unfused at this point. Yet in order to separate the copy sheet from the photoreceptor, the electrostatic tacking bond and other forces therebetween must be overcome. Various stripping systems have been utilized in the prior art. One such system is an air puffer applying a jet of air towards the lead edge of the copy sheet to initiate its separation from the imaging surface, as described, for example, in U.S. Pat. No. 3,062,536 to J. Rutkus, Jr., et al. Another is a vacuum stripping system. Various mechanical stripping system are known using stripping fingers for catching the lead edge of the copy sheet. An example of an effective mechanical stripping finger system is disclosed in U.S. Pat. No. 3,578,859 to W. K. Stillings cited above. This patent also discloses a vacuum manifold sheet guide system closely adjacent the photoreceptor and forming a part of the stripping system after stripping of the lead edge has been initiated. That is, once the lead edge of the sheet has been stripped and captured by a downstream sheet transport the remainder or body of the sheet can be removed by that transport.

Another post-transfer copy sheet stripping system is one which does not require such pneumatic or other mechanical stripping devices at all, or uses a mechanical stripper as a "back-up" system for stripping sheets whose weight, humidity, curl, or other condition renders them particularly difficult to strip from the imaging surface. Such non-mechanical stripping systems utilize the self-straightening tendency of the copy sheet to continue along a linear path when the imaging surface curves away from this path at the stripping area in combination with a detacking corotron to remove the tacking charge. The property of the copy sheet providing such self-stripping action is generally referred to as its "beam strength", or "stiffness", which is proportional to its cross-sectional moment of inertia, which is a function of the sheet thickness and material.

The ability of the copy sheet to self-strip is a function of the sheet stiffness, its residual tacking charge, and the photoreceptor radius. The effectiveness of the self-stripping action is increased by increasing the curvature of the imaging surface (in the direction of the imaging surface). However, this is limited by practical considerations. For example, if the imaging surface is a cylindrical drum, this curvature is controlled by the drum radius, which must be large enough to accommodate the various processing stations on the imaging surface. Where the imaging surface is a photoreceptor belt, a portion of it may be more sharply arcuately deformed (curved) in the stripping area, but its minimum radius will be subject in many cases to practical limitations of flexure strength, surface wave formations, etc., of the photoreceptor material, particularly for an inorganic photoreceptor.

The construction, operation, and function of self-stripping systems with detacking corotrons are taught in U.S. Pat. No. 3,870,515, issued Mar. 11, 1975, to Norbett H. Kaupp. It is based on an original application filed Oct. 11, 1966. In addition to continuously operating detack corotrons, it is known to pulse a detack corotron to act only upon the leading portion of the support material, i.e., the lead edge area of the copy sheet, while completing the stripping of the remaining portion of the copy sheet by having the downstream copy sheet vacuum transport pull the remaining portion away from the drum thereby mechanically stripping the sheet from the drum surface. This is generally suggested in U.S. Pat. No. 3,506,259, issued Apr. 14, 1970, to J. P. Caldwell et al., Col. 6, lines 30–41. Allowed pending U.S. Patent application Ser. No. 435,349 by Thomas Meagher et al. teaches a detack corotron power supply switching system wherein the D.C. bias levels to the A.C. detack corotron are at one level for the lead edge of the copy sheet and then switched to a different level for the body thereon. With this system the lead edge can be more highly charge neutralized than the body of the sheet to improve lead edge stripping.

Of particular interest to the present invention is U.S. Pat. No. 3,885,785, issued May 27, 1975, to Robert A. Burkett et al. which teaches stripping the body of the copy sheets from the photoreceptor at the furthest upstream point where the detacking corona emission begins neutralizing the transfer charge on the copy sheet, note, e.g., FIG. 2, and Col. 4, lines 14–39, and Claim 3 of this patent. Thus, most of the neutralization of the transfer charge occurs in this patent's structure after the stripping point and before the sheet reaches the vacuum transport. However, in the operation of some commercial Xerox 9200 duplicators, it is believed that the body of some copy sheets is stripping at the midpoint, or at or near the peak, of the detack corona emission similarly to the stripping location disclosed herein. Stripping is initiated by a vacuum stripping system which strips the lead edge of the copy sheet with air flow further downstream after much more neutralization than the body of the sheet is subjected to. However, in the 9200 duplicator the detack corona output is also being switched for the lead edge area as discused above.

Although the present invention may be utilized with a detack corona generator power supply output level switching arrangement as described above, it will be seen from the following description that it is not required. The disclosed apparatus utilizes previously known mechanical copy sheet lead edge stripping means and downstream copy sheet guide support surfaces, such as a vacuum manifold. The known advantage of charge neutralization of the lead edge of the copy sheet sufficiently to allow the lead edge of the copy sheet to more easily strip away from the curved photoreceptor surface is provided, yet without the known disadvantages of over-neutralizing the transfer charge on the body of the copy sheet before it is stripped. This is accomplished as shown herein by shifting of the stripping point for the body of the sheet to a different location relative to the detacking corona output than the stripping point of the lead edge. With the present system all but the lead edge of the copy sheet is stripped from the photoreceptor at a separation point or line intermediately of the detacking corona emission area where transfer charge neutralization has been partially accomplished, but is still in process.

It is known that by leaving a greater (unneutralized) residual transfer charge on the copy sheet at the stripping point, by stripping earlier in the detacking zone, that the toner is better retained on the copy sheet, for preventing retransfer problems such as hollow characters and providing improved transfer efficiency. Also, for the same (constant) detack corotron output, the charge on an area of the copy sheet is neutralized more effectively after it is removed the photoreceptor. Thus, stripping during (inside) the detack corona emission area is known to be desirable. However, premature stripping at a point with too great a residual transfer charge left on the copy sheet can also be disadvantageous, e.g., cause air gap breakdown with corona generation between the copy sheet and the photoreceptor.

Further objects, features, and advantages of the present invention pertain to the particular apparatus, steps, and details whereby the above-mentioned aspects of the invention are attained. Accordingly, the invention will be better understood by reference to the following description of an exemplary embodiment thereof, and to the drawings forming a part of that description, which are approximately to scale, wherein.

Figure 1:
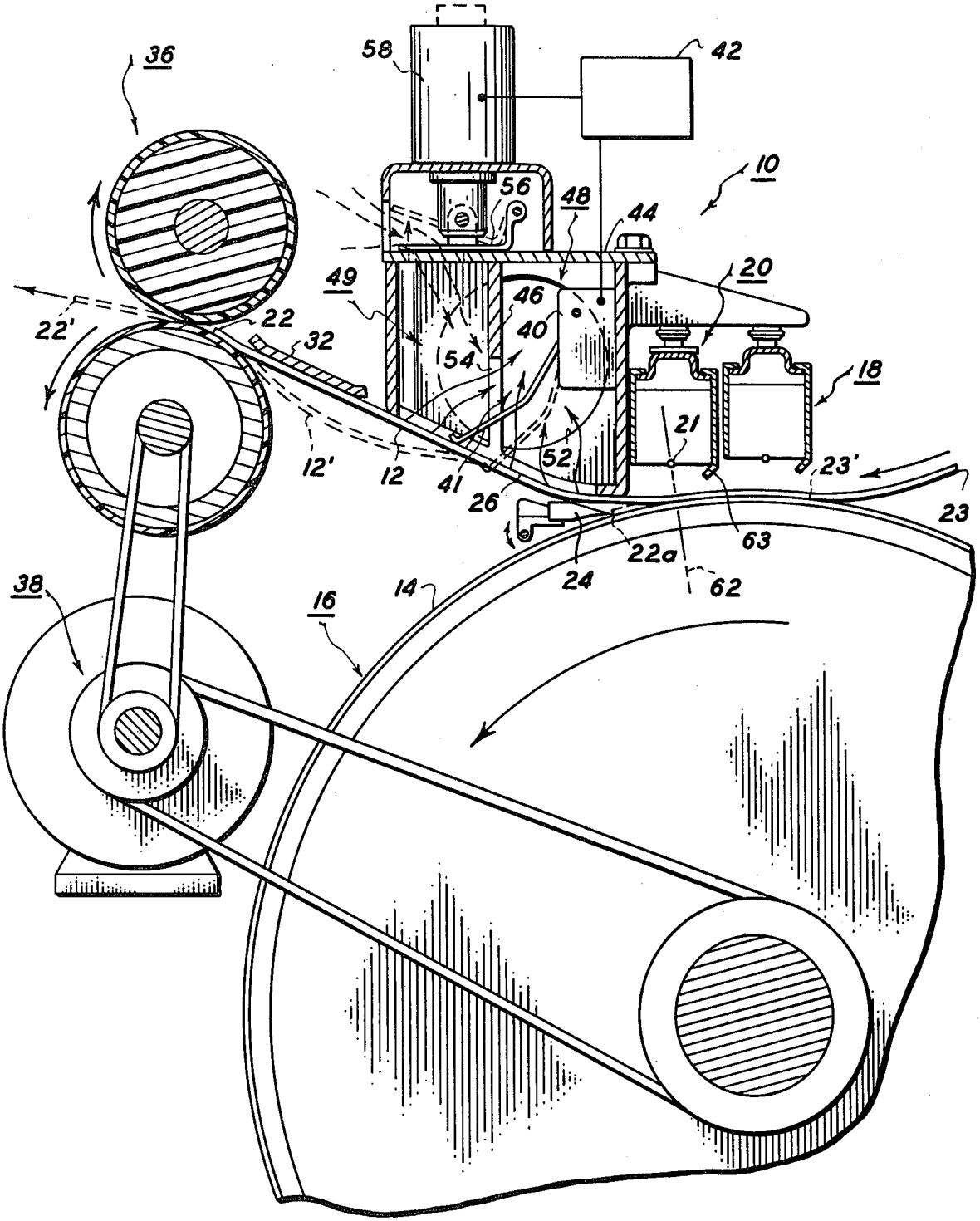
FIG. 1 is a cross-sectional side view of an exemplary xerographic copying apparatus in accordance with the present invention, illustrating those portions thereof relevant to the description of the present invention.
Figures 2, 3:
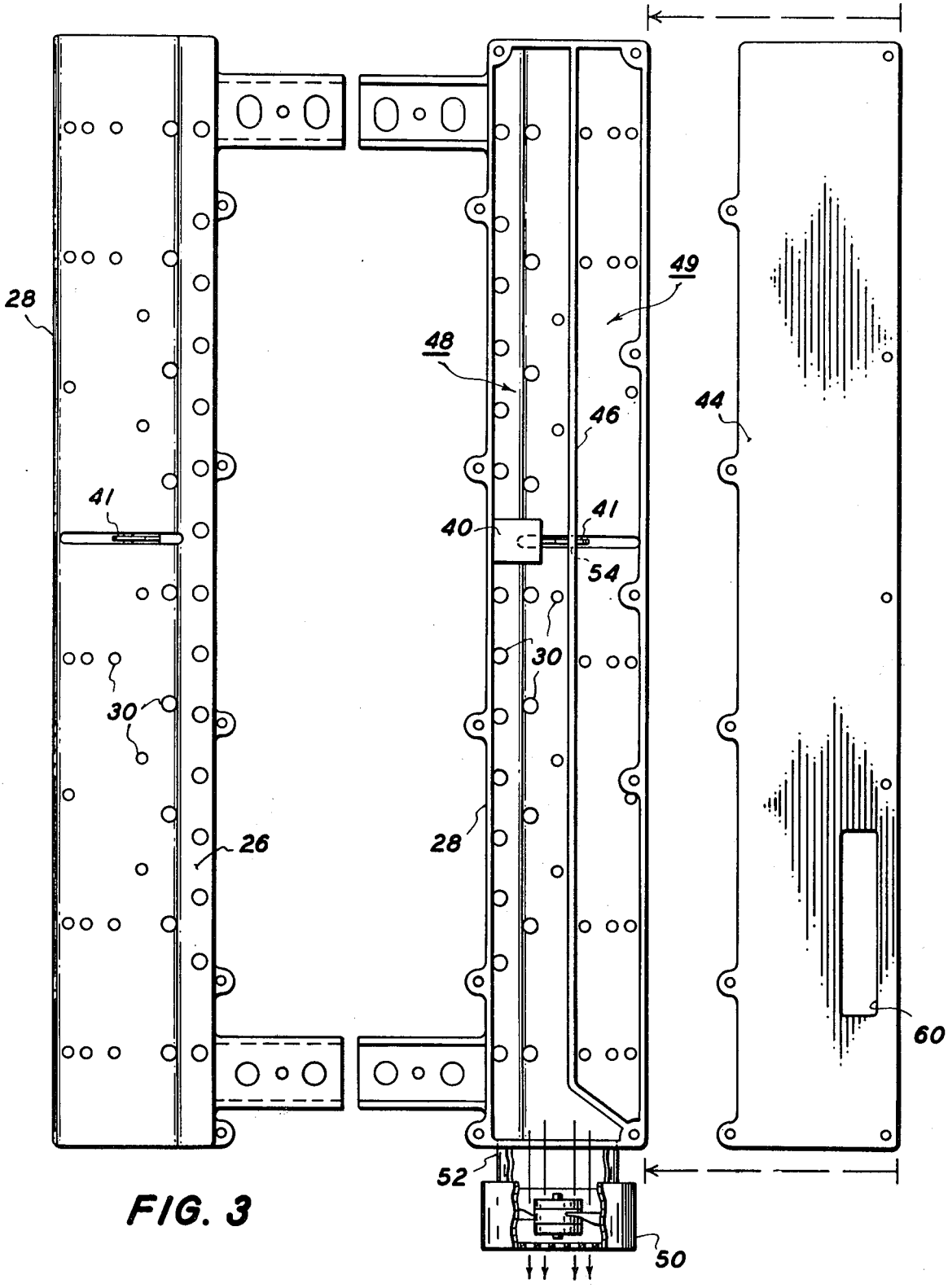
FIG. 2 is a top view of the vacuum manifold unit of the embodiment of FIG. 1, with the top cover thereof shown removed to the right side for clarity.
FIG. 3 is a bottom view of the vacuum manifold of FIGS. 1 and 2.

Referring now to the drawings, and specifically to the embodiment 10 of FIGS. 1–3, it may be seen that the xerographic transfer, stripping, vacuum manifold transport, and roll fusing system illustrated therein is generally similar in many respects to that of the Xerox 4000 and 4500 xerographic copiers. The above-cited disclosure of U.S. Pat. No. 3,578,859 or its equivalents, or other references, may be referred to for additional descriptions of examples of appropriate or conventional details of such systems. Accordingly, the following description will be directed specifically to the novel aspects of the embodiment providing a variable stripping point and variable resiudal transfer charge for the body of each copy sheet versus the lead edge of the same sheet.

Briefly first describing the overall disclosed system 10 in FIG. 1, it may be seen that a copy sheet 12 is sequentially brought into contact with, and transported at the same speed as, the initial image bearing surface 14 of a moving photoreceptor drum 16. The copy sheet 12 passes under a transfer corona generator 18 which applies electrostatic transfer charges to the back of a copy sheet and electrostatically tacks the copy sheet against the photoreceptor surface 14. The copy sheet 12 is then transported on the photoreceptor surface 14 under a detacking corona generator 20 which substantially reduces the transfer charges thereon, preferably with an alternating current corona emission. The lead edge of the copy sheet 12 is then stripped from the photoreceptor surface 14 by a mechanical stripping finger 24. The position of the copy sheet lead edge 22 just as stripping is initiated as illustrated here by the dashed line position 22*a*. The known mechanical stripping system illustrated here provides stripping initiation for most sheets. However, some sheets will self-strip before actual contact with the stripper finger with the neutralization of the transfer charge on the lead edge thereof. That is, the stripping member here functions as either as a "primary" system, as shown, or as a "back-up" system for these types or weights or conditions of paper which will self-strip, such as thick or outwardly pre-curled sheets.

As soon as the copy sheet lead edge 22 has been stripped from the photoreceptor surface 14, it is attracted to and guided over the generally planar, smooth stationary guide surface 26 here is shown in a bottom view of FIG. 3. It may be seen that it contains a plurality of vacuum apertures 30 capable of attracting and retaining the copy sheet 12 in intimate, shape conforming contact with the guide surface 26 as shown by the solid line position of the copy sheet 12.

The continuous electrostatic attachment of a (changing) intermediate segment of the copy sheet 12 behind its lead edge to the surface 14 provides a driving force for the copy sheet 12. The copy sheet is driven forward (downstream) at a velocity equal to that of the photoreceptor surface. The copy sheet 12 slides downstream over the guide surface 26, and past any further sheet guide members, such as the guide 32 shown here, toward the nip 34 of the roll fuser unit 36. The additional guide 32 would not be needed if the manifold guide surface 26 or an extension thereof extended sufficiently close to the fuser roll nip. In the solid line position of the copy sheet 12 illustrated in FIG. 1, the copy sheet is shown with its lead edge 22 just entering the fuser nip 34. It may be seen that in this position that the copy sheet 12 is fully engaged by and contiguous with substantially the entire guide surface 26 of the vacuum manifold unit 28.

Considering now the aspects of the system 10 relating to the above-cited patent of Raymond E. Poehlein, the relationship of the driving velocity of the fuser nip 34 and the photoreceptor drum 16 will be discussed first. A common direct mechanical drive interconnection 38 is illustrated between the axis of one of the fuser rolls and the axis of the photoreceptor drum 16. However, rather than being designed to provide an equal surface velocity for the fuser roll nip 34 as that of the photoreceptor surface 14, the drive interconnection 38 is arranged with suitable different pulley or gear diameters to provide a slightly slower speed for the fuser roll nip 34 than for the photoreceptor surface 14 in the transfer station. Thus, as the copy sheet 12 is advanced through the fuser nip 34, the lead edge 22 thereof is moving downstream at a slightly slower velocity than the intermediate and trailing areas of the same copy sheet are being advanced downstream by the photoreceptor surface 14. This would cause a potential force for slippage between the copy sheet 12 and the surface 14, which would cause toner image smears or skips, except that the system 10 provides means to allow the intermediate portion of the copy sheet 12, between the fuser roll nip and the transfer station, to form, with a low mechanical resistance, a buckle or bridge position away from the vacuum manifold unit guide surface 32. This buckle or bulge is allowed to freely expand out to a maximum position to take up or absorb the full accumulated speed differential of the entire copy sheet 12 until the trail edge 23 of the copy sheet is removed from the photoreceptor surface 14. This buckled or bridged position of the copy sheet 12 is illustrated by its dashed line position 12′ in FIG. 1. The leading and trailing edge positions of the copy sheet in its position 12′ are illustrated here respectively at 22′ and 23′. The buckle is always convex and expands further convexly as the copy sheet advances, relative to the fixed and generally planar guide surface 26. The loose toner image bearing side of the copy sheet faces away from the vacuum manifold 28.

Since in this system 10 the speed mismatch is compensated for by the buckle formed by the copy sheet backing up behind the slower fuser roll nip, and since the buckle expands away from the generally planar guide path 26, the buckle's maximum dimensions can increase to compensate for an increase in speed mismatch, or decrease to compensate for a decrease in speed mismatch. Thus, the present speed differential between the fuser roll nip and the photoreceptor surface is not critical and can vary during operation to accommodate for variations in the radius of the driven fuser roll, variations in the length of a copy sheet between its lead edge and trail edge, etc. The fuser roll nip velocity is preferably pre-set to always provide a somewhat slower speed (and, therefore, always provide a minimum buckle) sufficient to compensate for any normal machine operating latitude or changes, including those which would increase the nip velocity. This allows a fixed and uncritical fuser roll drive which does not have to be adjusted relative to the photoreceptor surface drive.

A sheet sensor 40 of a suitable or conventional mechanical switch (or photo-optical) type shown here provided in the path of the copy sheet 12 is an example of means providing an electrical signal indicative of the time at which the lead edge 22 of the copy sheet is first retained by the fuser roll nip 34. The switch 40 is shown in FIG. 1 positioned inside the vacuum manifold 28 with its switch actuating switch finger 41 extending through the bottom or guide surface 26. The finger 41 normally in the copy sheet path and is adapted to be moved from the illustrated dashed line position to the illustrated solid line position by the passage of the lead edge 22 of the copy sheet 12. A time delay circuit 42 can be utilized to provide an electrical output signal after a time period corresponding to the time required for the lead edge 22 of the copy sheet to be driven from the position of switch finger 41 into the fuser nip. Various other switch locations along the copy sheet path may be utilized, of course. Alternatively, other available machine logic signals may be utilized instead, e.g., signals derived from a main cam bank or logic unit of the copier.

A controlled buckle is formed in the copy sheet without disturbing of the toner image and without exerting sufficient mechanical force on the copy sheet to cause slippage of the portion of the copy sheet on the photoreceptor surface 14. This is accomplished here by the novel construction and operation of the vacuum manifold unit 28. Referring initially to FIG. 2, it may be seen that the vacuum manifold unit 28 may comprise an integral metal casting or the like with a top cover 44 which is shown removed in FIG. 2 for clarity. An internal divider or vertical wall 46 extends the full length of the interior of the manifold to divide the manifold into two separate plenum chambers 48 and 49. The wall 46 extends approximately, but slightly downstream of, the midpoint of the lower guide surface 26 of the vacuum manifold and transverse the paper path. Both plenum chambers 48 and 49 have copy sheet retaining vacuum apertures 30 therein, although the upstream plenum chamber 48 preferably has a larger number and diameter of vacuum apertures than the downstream chamber 49, particularly along the initial upstream edge of the guide surface 26 where the copy sheet is initially held by the vacuum manifold unit. (Note FIG. 3).

As shown in FIG. 2, vacuum is applied to the vacuum manifold unit 28 from a single vacuum pump 50, which may be a simple axial fan or centrifugal blower motor unit. An appropriate vacuum level inside the vacuum manifold may be approximately one and one-half inches of water, for example, or approximately 3.8 grams per square centimeter. With the arrangement here the vacuum pump 50 may be located at any desired position within the machine and connected by a vacuum conduit 52 to the rear wall of the vacuum manifold unit, for example. It is important to note, however, that the vacuum connection here is only to the upstream plenum chamber 48. The wall 46 is configured to isolate the vacuum input from the downstream plenum chamber 49. The only connection between the two plenum chambers, and therefore the only source of vacuum pressure for the upstream plenum chamber 49 here is through an air flow restrictive slot 54 centrally of the wall 46, as may be seen from the arrows indicating air flow patterns in FIG. 1.

With this vacuum arrangement, it may be seen that vacuum is maintained in the upstream plenum chamber 48 and, therefore, in the vacuum apertures 30 therein, at all times. This prevents the copy sheet from falling away or buckling away from the guide surface 26 of the vacuum manifold in the region of the upstream plenum chamber 48 at all times. Thus, the toner image bearing side of the copy sheet is prevented from contacting the stripper finger 24 or the photoreceptor surface 14 at any time and the paper path from the photoreceptor to the vacuum manifold is consistent. That is, after the initial lead edge stripping, the paper path between the area at which the body of the copy sheet strips from the photoreceptor and the vacuum manifold is constant and is maintained by the configuration and spacing of the upstream area of the vacuum manifold surface, since the copy sheet is maintained thereagainst at all times. Thus, shifting or changing of the stripping point of the copy sheet from the photoreceptor surface is prevented once the copy sheet lead edge has been captured by the vacuum manifold. This is important to prevent changes in the copy sheet charge level at stripping, since stripping for the body of the copy sheet occurs during (under) the detacking corona emissions generator 20.

In contrast, the vacuum within the downstream plenum chamber 49 is cyclically fluctuated during the machine operation with each copy sheet, as will be described. Specifically, the vacuum pressure in the plenum chamber 49 acting on the copy sheet is effectively removed during the time period in which it is desired to form the speed compensating buckle or bridge 12' in the copy sheet 12. That is, the vacuum force is removed from the vacuum manifold to allow the buckle to freely form in a controlled manner in that region, and downstream thereof, but not upstream thereof, with no vacuum force acting upon the sheet in its desired buckle region 12' during the formation of the buckle. Also, with this configuration the formation of the buckle is assisted by gravity, with the weight of the sheet in the buckle area tending to pull it downwardly away from the vacuum manifold 28 and any other guide 32. Thus, the formation of a buckle over a large area is pneumatically and mechanically unimpeded, and in fact is assisted. Yet the spread of the buckle region upstream is prevented by the continued retention of the downstream portion of the copy sheet against the vacuum apertures 30 in the upstream plenum chamber 48. Thus, the formation of the buckle in the copy sheet will not cause substantial slippage force to be generated or transmitted through the copy sheet upstream to that portion of the copy sheet in contact with the photoreceptor.

Referring to FIG. 1, the above-described cyclic removal of vacuum from the downstream plenum chamber 49 is accomplished here by a vent valve 56 rapidly operated by an electrical solenoid 58. Upon the receipt of an appropriately timed electrical signal, illustrated here by an electrical connection between the paper sensing switch 40 the time delay circuit 42 and the solenoid 58, the solenoid 58 operates to lift the vent valve 56 to its dashed illustrated position, thereby opening a vent opening 60 in the manifold top cover 44 to atmosphere (Note FIG. 2). This allows, as shown by the dashed airflow arrows in FIG. 1, ambient air to freely enter the downstream plenum chamber 49 and quickly drop the vacuum pressure therein to effectively zero. The vacuum connecting slot 54 through the wall of the wall 46 between the two plenum chambers continues to attempt to draw a vacuum therein, but this restrictive slot 54 is much smaller than the vent opening 60, and therefore is not capable of drawing a vacuum in the plenum chamber 49 when the vent opening 60 is opened by the vent 56. The relative proportions illustrated in the drawings are appropriate examples of these relative total areas, although the configuration, location and spacing thereof may be varied as desired.

Whenever the solenoid 58 is not actuated, i.e., as soon as the vent 56 is closed, a vacuum is applied from the vacuum blower 50 through the first plenum chamber 48 and the slot 54 in the wall 46 to draw a vacuum pressure level in the plenum chamber 49 comparable to that in the plenum chamber 48. The air flow path restriction provided by the slot 54, or other appropriate apertures between the two plenum chambers, is sufficiently restrictive in comparison to the total air flow provided by the vacuum pump 50 that the vacuum pressure in the plenum chamber 48 is not significantly affected by the sudden absence of vacuum in the plenum chamber 49 when the solenoid 58 is operated. However, a higher initial vacuum can, if desired, be provided in the front plenum chamber 48 for the same size blower, for providing a vacuum stripping assistance effect, for example.

When the copy sheet 12 covers the initial large vacuum holes 30 along the leading edge of the vacuum manifold, this reduces the air flow being drawn by the plenum chamber 48 through its vacuum holes 30. That allows an increase in the vacuum pressure available for the downstream plenum chamber 49 as the copy sheet moves theretoward from the area of the upstream plenum chamber 48, if so desired.

It is desirable to maintain full vacuum retention across the entire guide surface 26 of the vacuum manifold until the lead edge 22 of the copy sheet has been moved across the entire vacuum manifold and has entered the nip 34 of the fuser roll. It is particularly desirable to maintain a full vacuum holding force on the lead edge area of the sheet as it passes across the guide surface 26 of the downstream plenum chamber 49, particularly if this lead edge has a pre-set tendency to curl away from the manifold guide surface. Thus, the lead edge area of the copy sheet is fully supported from the photoreceptor until it is guided into the fuser. It is desired to remove the vacuum support from the copy sheet only after the lead edge of the copy sheet has been captured by, i.e., is supported in, the fuser nip 34. Also, the speed mismatch problem does not begin to occur until the copy sheet reaches the fuser nip. The preferred planar configuration of the guide surface 26 here provides a smooth, unobstructed, linear path for the copy sheet 12 up to this point in its downstream movement, which is illustrated by the solid line position of the copy sheet 12 in FIG. 1.

When the lead edge 22 of the copy sheet 12 reaches the fuser nip 34, the vent valve solenoid 58 is rapidly actuated, venting the plenum chamber 49 to atmosphere, and allowing the copy sheet to drop or bow away from the bottom surface of that plenum chamber 49. Since the pre-set effective linear speed of the fuser rolls nip is slightly slower than that of the photoreceptor drum, the copy sheet therefor immediately begins to form a buckle to begin to absorb and accommodate this speed mismatch. However, as noted, the vacuum in the upstream plenum chamber 48 is maintained, so that the buckle forms only between the fuser roll nip and up to approximately the area of the vacuum separating wall 46.

This condition continues as the copy sheet feeds forward through the nip. That is, the solenoid 58 retains the vent 56 open, and the buckle 12 continues to expand until it reaches its maximum buckle position, which determined by the amount of speed mismatch which it must absorb and the length of the copy sheet being fed.

Then, as soon as the trail edge of the copy sheet 12 reaches its position 23', (i.e., as soon as the trail edge of the copy sheet has been removed from contact with the photoreceptor surface, and before the trail edge can pass beyond the supporting surface of the upstream plenum chamber 48) the solenoid 58 is deactivated to close the vent 56 and thereby restore vacuum pressure in the downstream plenum chamber 49. This insures that the trail edge area of the copy sheet will be retained against the guide surface 26 under the downstream plenum chamber 49, and will not be allowed to flip, fall away of kick back upstream, which could cause disturbance of the loose toner image thereon, or a change in the stripping point, i.e., the trailing copy sheet area is retained in its passage over the entire vacuum manifold unit 28.

It may be seen that vacuum support for the copy sheet even under the downstream plenum chamber 49 is removed only for the intermediate portion of the copy sheet in which the desired buckle is being formed, and not for either the leading or trailing portions of the copy sheet. If desired, the vacuum vent 56 may close even before the trail edge 23 of the copy sheet has completely left the photoreceptor surface, as long as the copy sheet has exited the transfer zone under the transfer corona generator 18. It may also be seen that this same cycle is repeated for every copy sheet.

The removal of the solenoid 58 signal to reclose the vent 56 in response to the stripping of the trail edge of the copy sheet from the photoreceptor can be controlled by a copy sheet trail edge sensor in the paper path connected to appropriate circuitry such as a time delay circuit 42 here. Alternatively, the time delay itself can be pre-set based on a machine setting signal responsive to the size of the copy sheets, in the paper path direction, being utilized.

The following description relates to the different desired stripping positions of the lead edge of the copy sheet versus the main body of the copy sheet thereafter. A center line 62 is shown in FIG. 1 connecting the actual corona emitting element (wire) 21 of the detacking corona generator 20 on a radial center line of the photoreceptor 16, which is the closest point of the wire to the photoreceptor where this line crosses the photoreceptor surface. As discussed above, the position of the lead (upstream) area of the vacuum manifold unit and its angle relative to the photoreceptor surface 14 determines the angle and position of the unsupported length therebetween of the copy sheet 12 relative to the photoreceptor surface and, therefore, provides the control for the actual stripping point (line) at which the copy sheet first lifts away from the photoreceptor. For example, an approximately 200 mils spacing of the tip of the manifold above the photoreceptor is appropriate for the stripping position here.

In the present system this stripping position of the body of the sheet is made to occur on the photoreceptor at or closely adjacent to the center line 62, i.e., at or directly adjacent the actual corona emitting element 21 of the detack corona generator 20, and centrally of the ion emission area of the detack corona generator 20, rather than at the upstream or downstream side of the detack corona emission area. The conductive shield 63 of the corona generator 20 defines and controls its emission area on the copy sheet. Here it provides an approximately equal substantial emission distance on either side of the corona emitting element 21, corresponding to the shield wall spacing or opening. Within the emission area the ion current output is higher as the corona emitting element is approached, since the corona emitting element is closest to the photoreceptor and has a higher field acting on it in that region. That is, there is a peak corona emission under the corona emitting element 21.

With stripping set to occur directly under the detacking corona element 21 at line 62, the stripping is occuring while the detacking process is still proceeding, i.e., before the full charge neutralizing effect has occurred, and while a substantial transfer charge still remains on the copy sheet from the upstream transfer corona generator 18. The stripping point for the body of the copy sheet here is at, or slightly upstream of, (closely adjacent) the peak detack corona current output point. The rest of the detack corona current output downstream therefrom is applied to the unsupported stripped area of the sheet between the stripping point and its next support (the vacuum manifold 28).

However, it is important to note that this stripping point under the detacking corona generator electrode 21 is for the body of the sheet after the lead edge 22 has been stripped, not for the lead edge itself. As illustrated by the dashed line position **22*a* of the lead edge at the initial lead edge stripping point, this lead edge stripping point occurs after the lead edge has passed under substantially the entire detacking corona generator 20 and has been subjected to the full detacking corona emission while still in contact with the photoreceptor, so as to render the critical detacking of the lead edge much easier by much more fully removing the transfer charge therefrom. The stripper finger 24 here is positioned immediately downstream of the detacking corona generator 20, and closely under the upstream (lead) edge of the vacuum manifold unit 28, which defines the downstream end of the detacking zone here. The stripping edge of the finger 24 is closely spaced from both the guide surface 26 and the downstream edge of the detacking corona generator 20, so that the smallest possible lead edge distance of the copy sheet is subjected to the full detacking emissions, desirably one centimeter or less. The stripper 24 rapidly moves the lead edge up toward the manifold guide surface 26, and thereby quickly shifts or moves the stripping point for the rest of the sheet upstream to the above-described desired location, before any significant area of the copy sheet has past through the full detacking zone of the detacking corona generator 20**. Thus, it is insured that, at most, only the small marginal lead area of the copy sheet is separated in a region of low toner-retaining electrostatic charge remaining on the copy sheet (with consequent potential toner disturbance tendencies) whereas all the rest of the sheet separates while still having a high toner-retaining charge thereon. Ideally, if space is available, the stripper finger edge should be directly at or extended slightly into the downstream edge of the detack emission area to positively mechanically capture or prevent the lead edge from stripping beyond that point and therefor shifting the stripping point as soon as possible, i.e., with shortest lead edge area possible (less than 1 cm) regardless of the type or condition of the copy sheet. This is in contrast to a vacuum stripping system where the lead edge stripping point can vary, depending on the thickness, weight or other properties of the copy sheet.

It may be seen that the downstream shield 63 wall of the detack corona generator 20 is contiguous with the upstream wall of the manifold unit 28, so that the detack emission zone it defines extends uninterruptedly from the closely adjacent detack emission element 21 directly up to the manifold unit 28.

The entire integral unit disclosed here of a vacuum manifold together with the transfer and detack corotron units mounted thereto, it preferably mounted in the xerographic apparatus conventionally to be pivotable at one end yet maintainable in a fixed, pre-adjustable, spacing from the photoreceptor, as by a three point suspension system with conventional screw adjustable support pads on the machine framework. However, it will be appreciated that these three units may all be separately mounted if so desired.

If desired, one or both ends of the integral unit or individual units may instead be directly supported from the photoreceptor surface by low friction drum sliding or riding shoes or rollers resting against the edges of the photoreceptor surface, outside of the image utilized area. Photoreceptor drum riding supports are known for other processor units in xerographic copiers. For example, U.S. Pat. No. 3,918,403, issued Nov. 11, 1975, to R. C. Vock, teaches a transfer corona generator with a plurality of rollers contacting the back of the paper during transfer. U.S. Pat. No. 3,011,474, issued Dec. 5, 1961, to H. O. Ulrich teaches a photoreceptor roller mounted development electrode apparatus. A photoreceptor drum riding mounting arrangement allows the corona generator units and/or the vacuum manifold to be maintained at a pre-set constant spacing relative to the photoreceptor surface, irrespective of eccentricities or runout variations in the photoreceptor or its supports. However, the operating latitude of the present unit can accommodate normal such tolerances with a fixed mounting without requiring elimination of all relative movement between the unit and the photoreceptor.

It will be appreciated that vacuum may be selectively removed from selected areas of the vacuum manifold in other ways. For example, a sliding shutter could be utilized inside the bottom of the manifold to cover selected areas of the vacuum apertures in the sheet guide surface. With appropriate flow design this could also cause a selected increase in the vacuum pressure at the uncovered apertures, e.g., at the lead or stripping edge area.

It will be appreciated that the present invention may be utilized in many transfer and fusing system configurations other than those illustrated here where residual transfer charges on the copy sheet presents interrelated problems of transfer efficiency and sheet stripping. For example, the system may be one utilizing a bias transfer roller instead of a corona generator, as shown by example in U.S. Pat. Nos. 3,781,105, issued Dec. 25, 1973, to T. Meagher, or 3,895,793, issued July 22, 1975, to J. J. Bigenwald.

It will be noted with the embodiment disclosed herein that the copy sheet is supported by only a stationary or fixed guide member between the transfer station and a roll fusing station. This is advantageous in that rotating sheet transport members or belts with their additional mechanisms and expense are not required. However, the disclosed system could also be applied to a copier in which the lead area of the unfused copy sheet is gripped after stripping by mechanical grippers, vacuum belts or rollers, or the like while a trail area of the same sheet is on the photoreceptor, and the copy sheet is then subsequently fused in a radiant, flash or other type of fuser after the entire copy sheet has been removed from the photoreceptor.

In conclusion, it may be seen that there is disclosed herein an improved image transfer system. While the apparatus and steps disclosed herein are preferred, it will be appreciated that numerous variations and improvements may be made without significantly departing from the scope of the invention by those skilled in the art. The following claims are intended to cover all such variations and improvements as fall within the spirit and scope of the invention.

What is claimed is:

1. In an electrostatic image reproduction system wherein an image on a first image support surface member is transferred to a second image support surface member at a transfer station by means of electrostatic transfer means leaving an electrostatic transfer charge on the second image support member, and wherein the second image support member is then subjected to transfer charge neutralizing corona emissions by movement through a defined corona emission area from neutralizing corona emission means having a corona emitting element therein to neutralize the transfer charge on the second image support member, and wherein the second image support member is stripped from the first image support member by stripping means and transported away from said first image support member with transport means, and wherein said second image support member moves through the transfer station with a lead edge first, the improvement comprising the steps of:

stripping the lead edge of the second image support member away from the first image support member at a first fixed stripping position which is after the lead edge has moved through substantially the entire defined area of said neutralizing corona emissions from said neutralizing corona emission means by mechanically preventing the movement of the lead edge on said first image support member beyond said first fixed stripping position by the stripping means, and then, after the lead edge of the second image support member has been stripped away from the first image support member, shifting the stripping position of the remainder of the second image support member to a second fixed stripping position intermediately of said defined area of corona emissions by holding a portion of the second image support member on the transport means at a fixed position spaced relative to the first image support surface and the transfer charge neutralizing corona emitting element.

2. The electrostatic image reproduction system of claim 1, wherein said second fixed stripping position is centrally of said defined corona emission area.

3. The electrostatic image reproduction system of claim 1, wherein said second fixed stripping portion is centrally of said defined corona emission area and closely adjacent said corona emitting element and said first fixed stripping position is closely adjacent the edge of said defined corona emission area.

4. The electrostatic image reproduction system of claim 1, wherein the distance by which said stripping position of the second image support member is shifted from said first fixed stripping position to said second fixed stripping position is not more than approximately 1 centimeter.

5. In an electrostatic image reproduction system wherein an image on a first image support surface member is transferred to a second image support surface member at a transfer station by electrostatic transfer means leaving an electrostatic transfer charge on the second image support member, and wherein the second image support member is then subjected to transfer charge neutralizing corona emissions by movement, with a lead edge first, through a defined corona emission area from neutralizing corona emission means having a corona emitting element therein to neutralize the transfer charge on the second image support member, and wherein the second image support member is stripped from the first image support member by stripping means and transported away from said first image support member by transport means, the improvement wherein:

said stripping means strips the lead edge of the second image support member away from the first image support member at a first fixed stripping position located after the lead edge has moved through substantially the entire defined area of said neutralizing corona emissions from said neutralizing corona emission means by said stripping means positively mechanically preventing the movement of the lead edge on said first image support member beyond said first fixed stripping position, and said transport means shifting the stripping position of the remainder of the second image support member to a second fixed stripping position which is intermediate said defined area of corona emissions, and substantially spaced from said first fixed stripping point, by holding a portion of the second image support member on said transport means at a fixed position spaced relative to the first image support surface and the transfer charge neutralizing corona emitting element after the lead edge of the second image support member has been stripped away from the first image support member.

6. The electrostatic image reproduction system of claim 5, wherein said second fixed stripping position is centrally of said defined corona emission area and closely adjacent the peak corona emission area of said corona emission means for stripping said second image support member at a position where said transfer charge thereon is partially neutralized.

7. The electrostatic image reproduction system of claim 5, wherein said second fixed stripping portion is centrally of said defined corona emission area and closely adjacent said corona emitting element, and said first fixed stripping position is closely adjacent and edge of said defined corona emission area.

8. The electrostatic image reproduction system of claim 5, wherein the distance between said first fixed stripping position and said second fixed stripping position is not more than approximately 1 centimeter.

9. The electrostatic image reproduction system of claim 5, wherein said neutralizing corona emission means includes shield means spaced on opposite sides of said corona emitting element defining said defined corona emission area.

10. The electrostatic image reproduction system of claim 5, wherein said transport means comprises a fixed vacuum manifold guide surface spaced above said first image support member and closely adjacent an edge of said defined corona emission area.

* * * * *